US008746514B2

(12) United States Patent
Tudor et al.

(10) Patent No.: US 8,746,514 B2
(45) Date of Patent: Jun. 10, 2014

(54) DISPENSING DEVICE WITH VALVE ASSEMBLY HAVING CONTINUOUSLY SMOOTH TRANSITION BETWEEN TIP AND STEM

(75) Inventors: Thomas R. Tudor, Westland, MI (US); Mark J. Portelli, Wixom, MI (US)

(73) Assignee: Nordson Corporation, Westlake, OH (US)

( * ) Notice: Subject to any disclaimer, the term of this patent is extended or adjusted under 35 U.S.C. 154(b) by 539 days.

(21) Appl. No.: 12/705,210

(22) Filed: Feb. 12, 2010

(65) Prior Publication Data

US 2010/0206917 A1 Aug. 19, 2010

Related U.S. Application Data

(60) Provisional application No. 61/152,046, filed on Feb. 12, 2009.

(51) Int. Cl.
*B67D 3/00* (2006.01)

(52) U.S. Cl.
USPC ..... 222/504; 251/333; 251/903

(58) Field of Classification Search
USPC ..... 222/504, 559; 251/62, 63, 63.5, 332, 251/333, 903
See application file for complete search history.

(56) References Cited

U.S. PATENT DOCUMENTS

| | | | | |
|---|---|---|---|---|
| 1,545,758 A | | 7/1925 | Green et al. | |
| 2,025,296 A | | 12/1935 | McIntyre | |
| 2,952,439 A | * | 9/1960 | Koons | 251/357 |
| 3,090,596 A | * | 5/1963 | Gifford | 251/333 |
| 3,129,919 A | * | 4/1964 | Evans | 251/89.5 |
| 3,413,925 A | * | 12/1968 | Campolong | 417/357 |
| 3,446,154 A | * | 5/1969 | Fuchs | 417/568 |
| 3,489,171 A | * | 1/1970 | Michael, Jr. et al. | 137/556 |
| 3,508,739 A | * | 4/1970 | Allgeier, Jr. | 251/358 |
| 3,811,601 A | | 5/1974 | Reighard et al. | |
| 3,840,158 A | * | 10/1974 | Baker et al. | 222/487 |
| 3,950,839 A | | 4/1976 | DuPree et al. | |
| 4,050,315 A | | 9/1977 | Markfelt | |
| 4,525,910 A | * | 7/1985 | Boehmer | 29/890.127 |

(Continued)

FOREIGN PATENT DOCUMENTS

WO 2012158494 A1 11/2012

OTHER PUBLICATIONS

Nordson Corporation, "LA 825 RC Liquid Adhesive Dispensing Electric Applicators," PKL-09-5523, (Jul. 2009) (2 pages).

(Continued)

*Primary Examiner* — Kevin P Shaver
*Assistant Examiner* — Patrick M Buechner
(74) *Attorney, Agent, or Firm* — Wood, Herron & Evans, L.L.P.

(57) ABSTRACT

A dispensing device includes a housing having a material chamber in fluid communication with a material inlet port and a nozzle. The dispensing device also includes a valve in fluid communication with the material chamber and the nozzle. The valve includes a tip, a stem, and a seat. The stem is configured to move relative to the seat to control the flow of material exiting the housing through the nozzle. The tip is fixedly attached to the stem at a second distal. The tip includes a rounded head and a neck, the tip being fixedly attached to the stem by inserting the neck into a bore disposed within the stem.

13 Claims, 4 Drawing Sheets

(56) References Cited

U.S. PATENT DOCUMENTS

| | | | | | |
|---|---|---|---|---|---|
| 4,575,047 | A | * | 3/1986 | Boos et al. | 251/356 |
| 4,640,310 | A | * | 2/1987 | Hartle et al. | 137/883 |
| 4,687,017 | A | * | 8/1987 | Danko et al. | 137/315.01 |
| 4,850,807 | A | * | 7/1989 | Frantz | 417/63 |
| 4,913,601 | A | | 4/1990 | Tenand et al. | |
| 4,949,582 | A | * | 8/1990 | Vollweiler | 73/864.63 |
| 5,261,610 | A | * | 11/1993 | Waryu et al. | 239/585.4 |
| 5,409,165 | A | | 4/1995 | Carroll, III et al. | |
| 5,706,856 | A | | 1/1998 | Lancaster | |
| 5,711,281 | A | * | 1/1998 | Lorraine | 123/531 |
| 5,715,996 | A | * | 2/1998 | Cooper et al. | 239/533.7 |
| 6,086,039 | A | * | 7/2000 | Sievers et al. | 251/61.5 |
| 6,135,523 | A | | 10/2000 | Pratt | |
| 6,820,857 | B1 | * | 11/2004 | Lancaster | 251/85 |
| 6,932,322 | B2 | * | 8/2005 | Yanaka | 251/332 |
| 7,857,557 | B2 | | 12/2010 | Lehmann et al. | |
| 7,857,605 | B2 | * | 12/2010 | Tian et al. | 417/559 |
| 2006/0145107 | A1 | * | 7/2006 | Masamura et al. | 251/63.5 |
| 2006/0185654 | A1 | * | 8/2006 | Modien et al. | 123/568.21 |
| 2007/0034819 | A1 | * | 2/2007 | Mitsumata et al. | 251/129.14 |
| 2009/0224079 | A1 | * | 9/2009 | Johnson et al. | 239/584 |

OTHER PUBLICATIONS

U.S. Patent and Trademark Office, International Search Report and Written Opinion issued in International Application No. PCT/US2012/037459 mailed on Jul. 27, 2012 (7 pages).

U.S. Patent and Trademark Office, International Preliminary Report on Patentability issued in International Application No. PCT/US2012/037459 mailed on Apr. 26, 2013 (10 pages).

* cited by examiner 324
322
320
326
300
314
329
328
310
312

324
322
312

330
330
314
329
328
312

330
330
312

DISPENSING DEVICE WITH VALVE ASSEMBLY HAVING CONTINUOUSLY SMOOTH TRANSITION BETWEEN TIP AND STEM

This application claims priority to U.S. Ser. No. 61/152,046 filed on Feb. 12, 2009, the contents of which are hereby incorporated by reference.

BACKGROUND

Valves can be used to control the flow of material through an orifice. Certain valves, such as ball and seat valves and tip seal valves, include an arrangement whereby a shaft or stem includes a particularly-shaped tip, which is mated with a seat. One common shape for the tip is a substantially round ball, though other shapes are known as well. The valve is shut "off" when the tip is engaged with the seat and the valve is "on" when the tip is removed from the seat. The stem is typically connected to a piston or actuator that facilitates the movement of the tip relative to the seat. The tip and stem assembly typically moves linearly relative to the seat, thereby controlling the flow of material through the orifice in the seat. As discussed hereinafter, this type of valve will be identified generically as a "ball and seat" valve, though, as indicated above, the tip may have other shapes besides a "ball."

Such valve systems have many applications. For example, a ball and seat valve can be used as a one-way check valve that limits material flow through the orifice to one direction. Further, it can be used to selectively adjust (limit) the amount of flow through a system. An automatic or manual ball and seat valve can also be used in dispensing and metering systems. Dispensing and metering systems are generally used to provide a measured amount of material for a particular application. Dispensing and metering systems ensure that a specified amount of material is delivered each time the material is required. For example, manufacturing an automobile often requires numerous applications of precisely metered materials, such as the application of sealants to an automobile's body structure. Dispensing and metering devices can eliminate the guesswork, human error, and waste associated with trying to apply a precise amount of material by hand.

In certain applications, a valve can be subjected to harsh conditions that can potentially damage one or more components of the valve assembly. For example, such valve assemblies can be subjected to high pressure, corrosive materials, and strong forces from the flowing material. Such harsh conditions can potentially cause a tip to separate from its stem. Thus, the particular construction of the tip and stem assembly can be of significant importance. In applications subjecting the tip and stem assembly to such harsh conditions, the particular manner of bonding and/or press fitting a tip to a stem can greatly reduce the possibility of valve damage.

A tip and stem assembly can be constructed in many ways. For example, a tip and stem assembly can be made by rounding one end of a solid elongated cylindrical rod. However, the various manufacturing processes that can be used to round one end of a rod could lead to imperfections in the tip. Imperfections in the tip can cause mating problems between the tip and seat, and thereby lead to a leaky valve. A tip and stem assembly could also be made by welding a solid sphere to an end of a rod. However, such an assembly would have very limited bonding surface area between the sphere and the rod, possibly resulting in a tip and stem assembly that is more apt to separate under harsh conditions. Thus, to greatly reduce the possibility of damage to a tip and stem assembly subjected to harsh conditions, the tip and stem assembly should be constructed such that the tip is substantially free from deformities and securely bonded to a stem over a significant surface area.

DETAILED DESCRIPTION

Figure 1A:
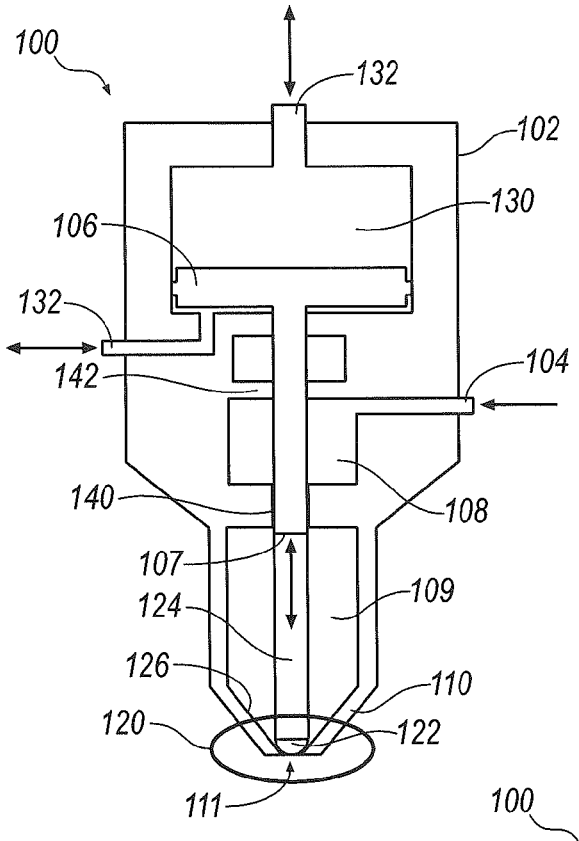
FIG. 1A illustrates a partial cross-sectional view of a dispensing device that utilizes a ball and seat valve, shown in a closed position.
Figure 1B:
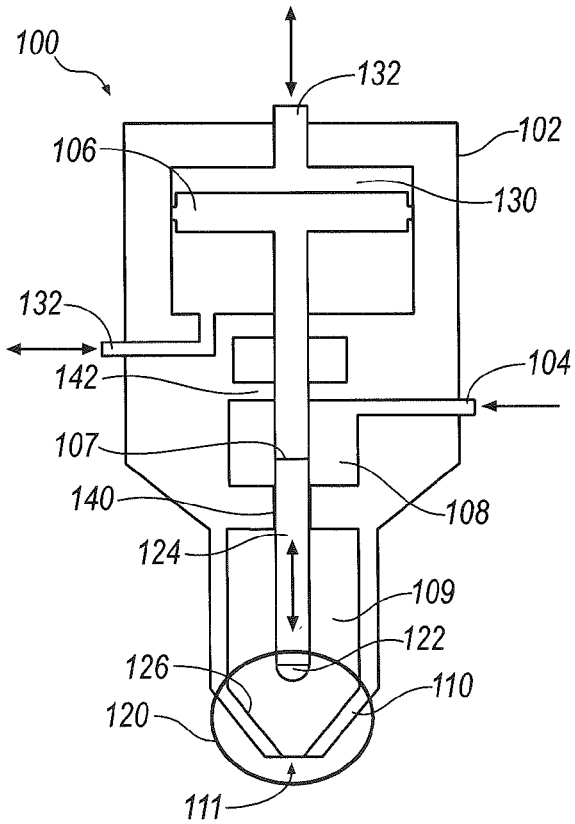
FIG. 1B is the partial cross-sectional view of the dispensing device of FIG. 1A, shown with the ball and seat valve in an open position.

FIGS. 1A-1B are partial cross-sectional views of a dispensing device 100 that can be used to dispense any type of flowable material, such as liquids, mixtures, slurries, etc. For example, dispensing device 100 can be used to dispense resin, epoxy, glue, grease, foam, etc. Dispensing device 100 can dispense such materials in a continuous fashion, or dispense a precise amount of material in a metered shot.

Dispensing device 100 includes a housing 102 that encloses the various components and provides the various inlets, outlets, chambers, and nozzle. Typically, housing 102 includes a material inlet port 104 that is in fluid communication with material chambers 108, 109, and a nozzle 110. Housing 102 also includes a valve 120, such as a ball and seat valve, that controls the flow of material through nozzle 110. Housing 102 can be designed in various shapes and sizes to correspond to varying applications.

As illustrated in FIGS. 1A-1B, material enters housing 102 through material inlet port 104, flows into material chamber 108/109, passes through valve 120 and exits through an orifice 111 in nozzle 110. The flow of material through nozzle 110 is controlled by valve 120. Valve 120 is shown in FIG. 1A in the closed position, and shown in an open or partially open position in FIG. 1B.

Generally, material is provided under varying amounts of pressure, flows through dispensing device 100, and exits through nozzle 110. Dispensing device 100 shown in FIGS. 1A-1B utilizes a ball and seat valve 120, which may also be referred to as a needle valve, to control the flow of material through nozzle 110.

Valve 120 is a ball and seat valve that includes a rounded or partially-spherical tip 122 disposed at the end of a stem 124. Tip 122 is configured to contact and mate with a seat 126 and form a fluid-tight seal to control the flow of material through an orifice 111 in nozzle 110. Typically, tip 122 is fixedly attached to stem 124, forming a tip and stem assembly. Stem 124 is typically attached to a piston 106 at a joint 107. As illustrated in FIGS. 1A-1B, piston 106 is an actuator that can control the flow of material through dispensing device 100 by controlling the distance between tip 122 and seat 126.

As shown in FIGS. 1A-1B, piston 106 is pneumatic and controlled by adding and subtracting air to and from an air chamber 130 via ports 132. However, dispensing device 100 can utilize any number of different mechanisms to operate valve 120 by moving piston 106, such as electric actuators, hydraulic pumps, etc. Piston 106 can be controlled by a pump, electronic controller, programmable logic controller (PLC), computer, etc. Piston 106 is shown substantially disposed within housing 102. However, piston 106 may be only partially disposed within housing 106, for example, when piston 106 is an electric actuator mounted externally to housing 102. In such a configuration, stem 124 may extend up through housing 102 and attach to an externally mounted piston 106 or actuator.

In addition, housing 102 can also includes one or more piston rings or guides 140, 142 that partially surround at least a portion of piston 106 and/or stem 124. Piston ring 142 may also include a sealing gasket that forms a seal against piston 106 thereby preventing material from flowing from material chamber 108 into air chamber 130. Piston rings 140, 142 are typically fixed in place in housing 102 and slidably engage piston 106 and/or stem 124, allowing valve 120 to move between open and closed positions.

As illustrated in FIG. 1A, valve 120 is shown in a closed position with tip 122 contacting seat 126 thereby blocking orifice 111 in nozzle 110. Piston 106 is capable of moving tip 122 vertically relative to seat 126 to control the flow of material through valve 120. Valve 120 is shown in an open position in FIG. 1B, where piston 106 has moved upward, thereby moving tip 122 up and away from seat 126 to allow material to flow through orifice 111 of nozzle 110.

Figure 2A:
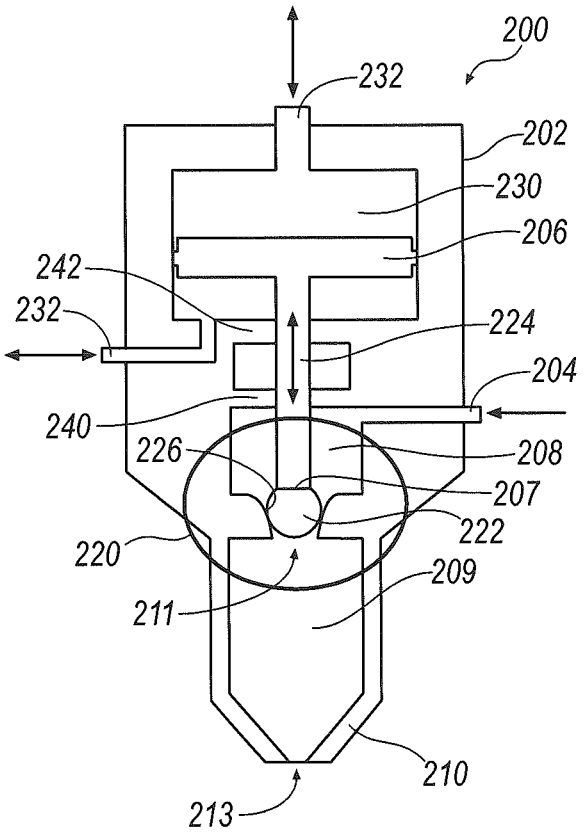
FIG. 2A illustrates a partial cross-sectional view of another dispensing device that also utilizes a ball and seat valve, shown in a closed position.
Figure 2B:
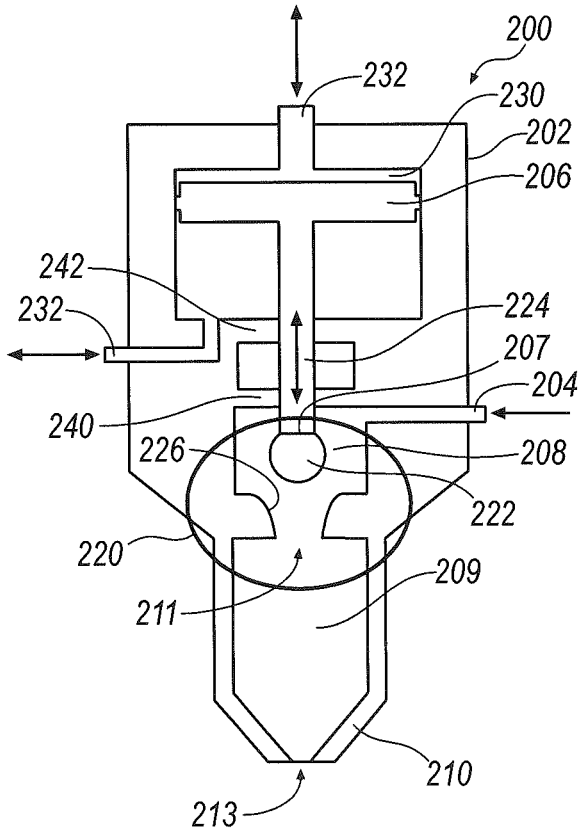
FIG. 2B is the partial cross-sectional view of the dispensing device of FIG. 2A, shown with the ball and seat valve in an open position.

Dispensing device 100 is configured such that valve 120 is in close proximity to nozzle 110. Such a configuration enables a near zero-cavity shut-off when valve 120 is closed, thereby sealing nozzle 110. In addition, such a configuration significantly limits, or even eliminates, any residual material flow after closing valve 120. FIGS. 2A-2B, on the other hand, illustrates a dispensing device 200 having a valve 220 separated from a nozzle 210.

As shown in FIGS. 2A-2B, valve 220 of device 200 includes a housing 202 that encloses the various components and provides the various inlets, outlets, chambers, and nozzle. Housing 202 of device 200 also includes a material inlet port 204 that is in fluid communication with material chambers 208, 209, and a nozzle 210. Valve 220 is a ball and seat valve that includes a seat 226, and a ball 222 that is connected to piston 206 by way of a stem 224. Valve 220 is also operated by way of a piston 206 to control the flow of material through an orifice 211 in seat 226, through nozzle 210, where material can exit through a nozzle outlet 213. As illustrated in FIGS. 2A-2B, seat 226 of valve 220 is in material chamber 208 and positioned some distance away from the outlet of nozzle 210.

Valve 220 is shown in FIG. 2A in the closed position, and shown in an open or partially open position in FIG. 2B. Tip 222 of valve 220 is a rounded or partially-spherical and located at the end of stem 224. Stem 224 is typically attached to piston 206 at a joint 207. Piston 206 is pneumatic and controlled by adding and subtracting air to and from an air chamber 230 via ports 232. In addition, housing 202 can also include one or more piston rings or guides 240, 242 that partially surround and slidably engage at least a portion of piston 206 and/or stem 224. Of course, dispensing device 200 can utilize any number of different mechanisms to operate valve 220, such as electric actuators, hydraulic pumps, etc. As illustrated in FIG. 2A, valve 220 is shown in a closed position with tip 222 contacting seat 226 thereby blocking orifice 211 of seat 226. Valve 220 is shown in an open position in FIG. 2B, where piston 206 has moved upward and away from seat 226 to allow material to flow through orifice 211 and into nozzle 210.

Dispensing devices 100 and 200 both rely on a ball and seat valve to control the flow of material through their respective nozzles. Typically, such ball and seat valves include a tip and stem assembly connected to a piston or actuator. Certain applications require corrosive materials, high pressure, and other factors that can damage a valve assembly. For example, certain conditions can greatly strain the bond between a tip and a stem. In addition to withstanding great amounts of strain, certain corrosive materials can also potentially damage the bond between a tip and a stem. Therefore, a tip should be strongly adhered to a stem, as discussed in detail below.

Figures 3A, 3B, 3C, 3D:
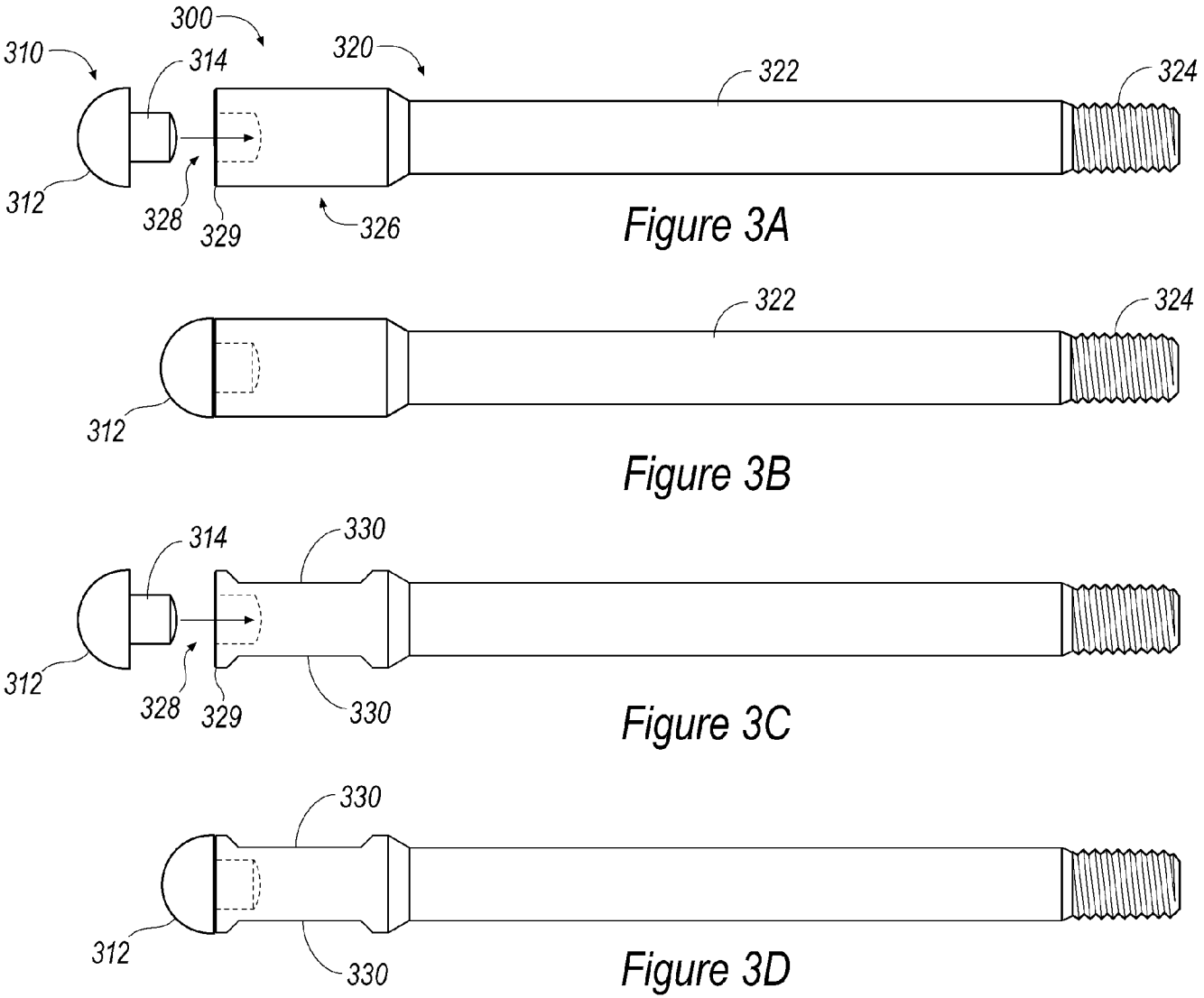
FIG. 3A is a side view of a tip and stem assembly illustrating the tip disengaged from the stem.
FIG. 3B is a side view of the tip and stem assembly of FIG. 3A illustrating the tip joined to the stem.
FIG. 3C is a side view of the tip and stem assembly of FIG. 3A rotated 90 degrees about the long axis of the stem.
FIG. 3D is a side view of the tip and stem assembly of FIG. 3B rotated 90 degrees about the long axis of the stem.

FIGS. 3A-3B illustrate a tip and stem assembly 300 for use in a ball and seat valve, such as valves 120 and 220. Tip and stem assembly 300 can be used in any number of different dispensing and metering systems, one-way check valves, or any other type of fluid system that can utilize a ball and seat valve. Tip and stem assembly 300 includes a tip 310 and a stem 320, and can provide significantly enhanced connection between tip 310 and stem 320. In addition, the particular arrangement between tip 310 and stem 320, as shown in FIGS. 3A-3D, can also reduce the amount of strain between tip 310 and stem 320 that can occur in applications that subject a ball and seat valve to harsh conditions. Further, the particular assembly provides greatly enhanced lateral support, significantly reducing the possibility of having tip 310 separate from stem 320 due to any shear or lateral forces.

Tip and stem assembly 300 provides a solid one-piece construction after assembly. Assembly 300 also provides greatly increased bonding surface area between tip 310 and stem 320. Further, assembly 300 is relatively simple and economical to produce. In addition, the disclosed assembly 300 also ensures that tip 310 is properly centered and aligned when mounted to stem 320, thereby preventing numerous issues that can arise from having tip 310 misaligned when attached to stem 320. As will be discussed in detail below, manufacturing tip and stem assembly 300 requires relatively few manufacturing steps and is easily adaptable to suit varying applications without expensive tooling changes.

Tip and stem assembly 300 includes a tip 310 and a stem 320. Tip 310 is configured to serve as the ball portion of a ball and seat valve, such as valves 120 and 220. Tip 310 includes a head 312 and a neck 314. Head 312 is rounded and configured to mate with a seat, such as seat 126, 226 to form a fluid-tight seal for a ball and seat valve. Neck 314 is generally cylindrical and configured to mate with stem 320 specifically by being received within a hollow bore 328 disposed at a distal end of stem 320.

Stem 320 includes an elongated cylindrical shaft 322 with threads 324 disposed near a first distal end, and a bore 328 disposed at an opposing cylindrical distal end 329. Bore 328 is a generally cylindrically shaped hollow portion that is configured to receive neck 314 of tip 320. Bore 328 is typically a cylindrical hole centered in stem 320, thereby ensuring that tip 310 is properly aligned with stem 320 after installation. As shown, neck 314 and bore 328 are cylindrical. However, bore 328 and neck 314 may be shaped in any complimentary fashion such that neck 314 can mate with bore 328. Tip 310 can then be secured to stem 320 by securing neck 314 within bore 328. For example, neck 314 and bore 328 can be sized to establish an interference fit when neck 314 is inserted into bore 328. For example, neck 314 can have a diameter that closely approaches an interior diameter of bore 328. Tip 310 can then be secured to stem 320 by press fitting neck 314 into bore 328.

Bonding between neck 314 and bore 328 can also be accomplished or enhanced using adhesives, welding, soldering, etc. For example, tip 310 can be press fit into stem 320 by applying force to tip 310 to insert neck 314 into bore 328. The bond between neck 314 and bore 328 can then be enhanced using silver solder, for example. However, tip 310 can be secured into stem 320 using any number of different mechanisms, including those that reasonably secure tip 310 to stem 320. For example, neck 314 and bore 328 can each include complementary threads allowing tip 310 to be screwed into stem 320. Such a configuration may provide an easy mechanism for interchanging tips 310 should one become damaged.

Tip 310 is typically sized to ensure a fluid-tight seal with a valve seat, such as seat 126. Head 312 of tip 310 can also be sized to substantially match the diameter of stem 320, as shown in FIGS. 3A-3D. Such a configuration can reduce the amount of strain between tip 310 and stem 320 by providing a smooth transition between tip 310 and stem 320, as illustrated in FIGS. 3B and 3D.

Stem 320 may also include a pair of complementary wrench flats 330 disposed anywhere along stem 320. As illustrated in FIGS. 3A-3D, wrench flats 330 are disposed near the end that includes bore 328. In configurations where stem 320 includes threads 324 for installing assembly 300 into place, wrench flats 330 enable an installer to use a wrench to screw stem 320 into a piston or actuator. For example, a piston or actuator may include female threads complementary to male threads 324 of stem 320. FIGS. 3C-3D illustrate the assembly 300 of FIGS. 3A-3B rotated 90 degrees about the long axis of stem 320. As shown in FIGS. 3C-3D, wrench flats 330 provide two opposing flat surfaces that will allow a wrench to easily twist and torque stem 320.

Figure 4A:
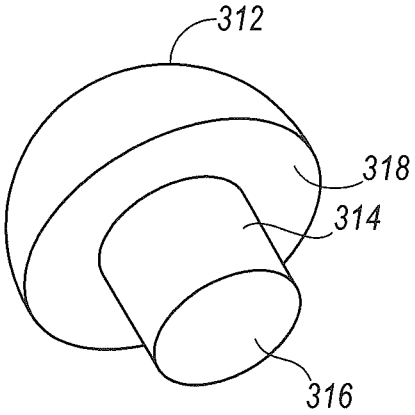
FIGS. 4A-4B illustrate perspective views of a tip.
Figure 4B:
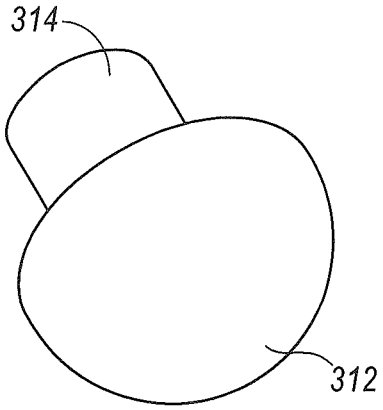
Figure 4C:
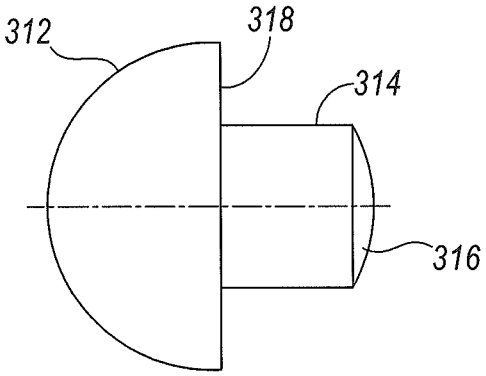
FIG. 4C is a side view of the tip of FIGS. 4A-4B.
Figure 4D:
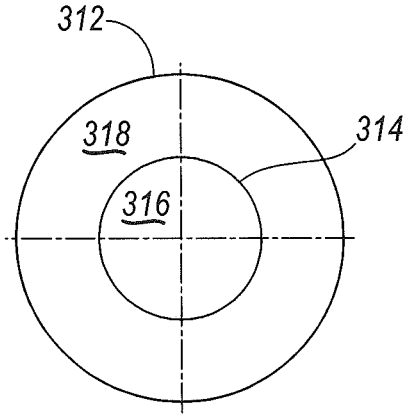
FIG. 4D is a rear view of the tip of FIGS. 4A-4C, looking toward a neck portion of the tip.

FIGS. 4A-4D illustrate various views of tip 310. FIGS. 4A-4B are perspective views of tip 310. FIG. 4C is a side view, and FIG. 4D is a rear view looking at neck 314. As shown in FIG. 4A, tip 310 includes a rounded head 312 and a cylindrical neck 314. Neck 314 includes a rounded end 316, and head 312 includes a substantially flat underside 318. As previously discussed, neck 314 is configured to be inserted into bore 328 of stem 320. Although neck 314 is shown having a rounded end 316, the end could be substantially flat, or any other shape. Generally, end 316 is simply inserted into bore 328 and may or may not be bonded to the interior walls of bore 328. End 316 may be rounded as a result of a particular manufacturing operation. Underside 318 is substantially flat in order to form a tight and substantially uninterrupted transition between tip 310 and stem 320. Having a smooth or substantially uninterrupted transition between tip 310 and stem 320 minimizes pressure and strain that between tip 310 and stem 320, for example, minimizing such forces that pull tip 310 away from stem 320. In addition, underside 318 may provide even more bonding surface area used to bond tip 310 to stem 320 (at cylindrical distal end 329). Of course, the particular bonding between tip 310 and stem 320 may depend on the type of material(s) used, the application, customer specifications, etc.

Tip 310 and stem 320 can be made using a wide variety of materials. The choice of materials may vary considerably depending on a particular application, cost, customer requirements, etc. Such materials may include any number of different metals and/or plastics, including carbide, stainless steel, chrome, etc.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. One such example is that the tip may take on a variety of shapes, even though the figures generally only show a rounded tip. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

We claim:

1. A dispensing device, comprising:

a housing having an inlet port in fluid communication with an outlet nozzle;

a valve that selectively permits and prevents flow of material through said outer nozzle in response to an automated actuator, said valve comprising:

a valve stem including a distal end portion defining a cylindrical shape and having a bore;

a valve tip having a head portion and a neck portion, said head portion consisting of a partially-spherical body terminating in a flat underside from which said neck portion extends, said neck portion being inserted into said bore in said valve stem so as to fixedly couple said valve tip to said valve stem; and wherein said head portion has a maximum diameter at said flat underside that matches a diameter of said cylindrically-shaped distal end portion of said valve stem that abuts said flat underside of said head portion so as to create a continuously smooth transition between said head portion of said valve tip and said valve stem, wherein said valve tip is secured to said valve stem by press fitting said neck portion of said valve tip into said bore and enhancing a bond between said neck portion and said bore by applying solder or adhesive at a first joint area that is press fit together to define an interference or frictional fit, and wherein the securing of said valve tip to said valve stem is further enhanced by applying solder or adhesive at a second joint area defined by an abutting contact formed between said flat underside of said head portion and said distal end portion of said valve stem.

2. The dispensing device of claim 1, wherein said neck portion of said valve tip is cylindrical.

3. The dispensing device of claim 1, wherein said valve stem is releasably secured to the actuator.

4. The dispensing device of claim 1, wherein said outlet nozzle is spaced from a valve seat of said valve such that flow through said valve seat enabled by movement of said valve tip away from said valve seat provides flow into a material chamber larger in cross-section than said valve seat and said outlet nozzle, said material chamber being located between said valve seat and said outlet nozzle.

5. The dispensing device of claim 1, wherein said valve stem includes a grip portion defined by opposing wrench flats formed proximally from said distal end portion defining a cylindrical shape.

6. The dispensing device of claim 5, wherein said bore for receiving said neck portion of said valve tip is at least partially coextensive with said grip portion.

7. The dispensing device of claim 6, wherein said valve stem is defined by an elongated shaft that is enlarged at said grip portion to accommodate said opposing wrench flats and said bore, and wherein said elongated shaft includes threads at an opposite end from said grip portion for releasably securing said valve stem to said actuator.

8. A dispensing device, comprising:

a housing having an inlet port in fluid communication with an outlet nozzle;

a valve that selectively permits and prevents flow of material through said outer nozzle in response to an automated actuator, said valve comprising:

a valve stem including a distal end portion defining a cylindrical shape and having a bore;

a valve tip having a head portion and a neck portion, said head portion consisting of a partially-spherical body terminating in a flat underside from which said neck portion extends, said neck portion being inserted into said bore in said valve stem so as to fixedly couple said valve tip to said valve stem; and wherein said head portion has a maximum diameter at said flat underside that matches a diameter of said cylindrically-shaped distal end portion of said valve stem that abuts said flat underside of said head portion so as to create a continuously smooth transition between said head portion of said valve tip and said valve stem, and wherein said outlet nozzle is spaced from a valve seat of said valve such that flow through said valve seat enabled by movement of said valve tip away from said valve seat provides flow into a material chamber larger in cross-section than said valve seat and said outlet nozzle, said material chamber being located between said valve seat and said outlet nozzle.

9. The dispensing device of claim 8, wherein said neck portion of said valve tip is cylindrical.

10. The dispensing device of claim 8, wherein said valve stem is releasably secured to the actuator.

11. The dispensing device of claim 8, wherein said valve stem includes a grip portion defined by opposing wrench flats formed proximally from said distal end portion defining a cylindrical shape.

12. The dispensing device of claim 11, wherein said bore for receiving said neck portion of said valve tip is at least partially coextensive with said grip portion.

13. The dispensing device of claim 12, wherein said valve stem is defined by an elongated shaft that is enlarged at said grip portion to accommodate said opposing wrench flats and said bore, and wherein said elongated shaft includes threads at an opposite end from said grip portion for releasably securing said valve stem to said actuator.

* * * * *

UNITED STATES PATENT AND TRADEMARK OFFICE

CERTIFICATE OF CORRECTION

PATENT NO. : 8,746,514 B2
APPLICATION NO. : 12/705210
DATED : June 10, 2014
INVENTOR(S) : Thomas R. Tudor et al.

It is certified that error appears in the above-identified patent and that said Letters Patent is hereby corrected as shown below:

Title page:

At [57], line 8, after "distal" insert --end--.

In the Specification:

Column 3

Line 19, change "includes" to --include--.

Line 42, change "illustrates" to --illustrate--.

Line 59, delete "a".

Column 4

Lines 63-64, change "complimentary" to --complementary--.

Column 5

Line 54, delete "that".

In the Claims:

Column 6

Claim 1, line 27, change "outer" to --outlet--.

Column 7

Claim 8, line 18, change "outer" to --outlet--.

Signed and Sealed this
Twenty-third Day of September, 2014

Michelle K. Lee

Michelle K. Lee
*Deputy Director of the United States Patent and Trademark Office*